US005415408A

United States Patent [19]

Livesay et al.

[11] Patent Number: 5,415,408

[45] Date of Patent: May 16, 1995

[54] GOLF CLUB

[75] Inventors: Mark Livesay, El Cajon; Ronnie S. Pritchett, Palm Desert, both of Calif.

[73] Assignee: Putt Masters Inc., Palm Desert, Calif.

[21] Appl. No.: 230,133

[22] Filed: Apr. 20, 1994

Related U.S. Application Data

[63] Continuation-in-part of Ser. No. 19,212, Feb. 25, 1994, abandoned.

[51] Int. Cl.[6] ..... A63B 69/36

[52] U.S. Cl. ..... 273/187.4; 273/162 B; 273/DIG. 14

[58] Field of Search ..... 273/187.4, 187.6, 185 R, 273/32 H, 193 R, 194 R, 164.1, 162 B, 162 F, 32 B, 32 H, 185, DIG. 14; 33/293, 295, 365, 391, 508, 555.1, 555.2

[56] References Cited

U.S. PATENT DOCUMENTS

| | | | |
|---|---|---|---|
| 1,125,029 | 1/1915 | Lard | 273/80 B |
| 1,218,091 | 3/1917 | Lard | 273/80 B |
| 2,236,414 | 3/1941 | Reach | 273/80 A |
| 2,579,644 | 12/1951 | Bergman | 273/162 B X |
| 2,919,491 | 1/1960 | Darrell | 273/162 B |
| 3,806,133 | 4/1974 | Cork | 273/80 R |
| 4,179,125 | 12/1979 | Cone | 273/162 B |
| 4,212,467 | 7/1980 | Shiratori | 273/187.4 |
| 4,369,974 | 1/1983 | Komperda | 273/DIG. 14 |
| 4,795,153 | 1/1989 | Thomas | 273/81.3 |
| 4,927,151 | 5/1990 | Ronnick | 273/162 B |
| 5,026,062 | 6/1991 | Freeberg | 273/187.4 |

*Primary Examiner*—Sebastiano Passaniti
*Attorney, Agent, or Firm*—John Lezdey

[57] ABSTRACT

A golf club having a sighting arrangement within the shaft. The sighting arrangement is an aperture positioned above a vertically extended slot for projecting an imaginary target area on the ground.

13 Claims, 1 Drawing Sheet

GOLF CLUB

RELATED APPLICATION

This application is a continuation-in-part of design application Ser. No. 29/019,212 filed Feb. 25, 1994, pending.

FIELD OF THE INVENTION

This invention relates to golf clubs especially to a putter or more particularly to a putter having a feature for aiding the golfer to determine a specific target area to which the ball should be directed and advanced to more accurately travel towards the golf cup.

DESCRIPTION OF THE PRIOR ART

In golf it is customary for a player to lay his putter on the green to aid in determining the contour of the ground between the ball and the cup in order that he may judge "the rough" required to sink the ball without overrunning the cup.

Golf greens are ordinarily not truly flat, there generally being some slope or undulations in the green between the gold ball and the cup. As is well known to golfers, most putts cannot be made in a straight line. That is, the ball is not struck directly toward the cup or hole but must be stroked at an angle to compensate for deflection or "break" imparted by the slope or undulations of the green. A golfer must by visual observation estimate the deflection or "break" with which to stroke the ball. A misreading of the deflection or "break" of the green results in missed putts. Such observations of the slope or undulation of the green is done without relation to a proper reference. For example, a green may have a gentle uniform transverse slope along the line between the ball and the hold or cup.

This slope requires that the ball be putted not directly toward the cup but at a slight angle toward the higher side of the green in order that the deviation in the ball path caused by the slope will be sufficient that the ball will follow a curved path towards the cup. These undulations or slope variations require a judgment by the golfer that is part of the game referred to as "reading the green". This judgment requires determining the amount of deflection with which to stroke the ball as well as the force with which the ball is to be struck.

Another factor to be considered in "reading the green" is the natural lie or break of the grass of the green, i.e., the tendency of the grass to lean in one direction. Accordingly, a golf ball putted on the green will roll in the direction of the lean of the grass. The ability to read this lie or break in the green assists the golfer in determining the direction the ball will take, as well as, determining the force necessary to move the ball towards the cup or hole. In "reading the green" many golfers hold the putter in a vertical position to sight the green along the edge of the golf club shaft in an attempts to determine the break of the green.

Several devices have been patented to help estimate the contours of the putting green. U.S. Pat. No. 2,919,491 to Darrell and Channing is directed to a putter having incorporated in the grip handle an elongated level bulb. The golfer has to place the putter on the green adjacent to the ball with the toe end of the club directed to the hole. The slope of the green is indicated by the bubble in the level in the conventional manner of using a level. U.S. Pat. No. 3,186,092 to Bertas discloses an optical device to read the slope or undulation of a putting green. The devices comprises a transparent member which is adapted for detachable mounting on the shaft of a golf club. By sighting through the transparent member with the horizontal reference line aligned with the cup, the golfer is able to accurately estimate the slope or undulations of the green with reference to the horizontal reference line. U.S. Pat. No. 4,212,467 to Shiratori discloses another optical devices wherein the shaft of the golf club is provided with a transparent portion having an indices extending along the vertical direction to observe that the natural lie of the grass can be made more easily seen by reference to the angle made by the grass with the indices. However, no mention is made regarding the determination of the pitch or the undulations of the green using the Shiratori device. The main focus of this device is the determination of the angle of the grass makes with the indices. Further, there is no provision for indicating projected target area on the green.

Accordingly, there continues a need for a device incorporated into a golf club which provides means for enabling the golfer to judge more accurately the deflection angles, stroking forces and the natural lie of the grass.

SUMMARY OF THE INVENTION

According to the present invention, there is provide a sighting arrangement means fixed within the golf shaft comprising in spatial relationship an aperture positioned above a vertically extended slot for determining an imaginary target area on the green. Once the target areas is established the ball is stroked with sufficient force to pass through the target area towards the hold or cup. This imaginary target area enables the golfer more accurately to compensate for the slope or undulations and break in the golf green between the ball and the hole and to determine the deflection and force required to stroke the ball towards the hole or cup.

A preferred embodiment of the improved shaft of the invention involves a sighting arrangement means comprising transparent inserts in the aperture, which is preferably circular, and in the vertical slot each preferably having indicia means. In use the gold club is loosely held in a vertical position behind the ball. By first sighting the ball through the vertical slot on an imaginary line between the ball and cup and then viewing through the aperture, the golfer is able to establish an imaginary target area on the green. Thus, the golfer is able to compensate for the variables mentioned above.

In accordance with the present invention a method of making the golf shaft having a sighting arrangement comprises the steps of:

- machining or stamping through the hollow interior of the shaft in a plane demarcated by the vertical axis a vertically extending rectilinear slot;
- drilling through the shaft an aperture in spatial relationship above said rectilinear slot.

Another embodiment relative to a method of making the golf shaft in accordance with the present invention comprises:

- filling the hollow interior of said shaft with a transparent epoxy-catalyst mixture;
- curing said transparent epoxy-catalyst mixture to form an inner shaft within the outer shaft;
- cutting two vertically rectilinear slots in a plane demarcated by the vertical axis of one hundred eighty degrees from each other in said outer shaft; and cutting two apertures one hundred eighty degrees from each other in said outer shaft, Still another embodiment relative to a method of making the golf shaft in accordance with the present invention comprises:

removing about a 4 inch to about a 7 inch portion of the shaft to form a top segment and a bottom segment;

removing and disposing of said segment;

applying to both ends of a preformed sighting arrangement means a suitable adhesive; and inserting the preformed sighting arrangement mean with the aperture above the vertical slot end into the top segment and the remaining end into the bottom end to produce the golf shaft.

It is therefore an object of the present invention to provide a new and improved golf club shaft to enable golfers to read greens with improved accuracy.

An object of this invention is to enable a golfer to project a target area on the green to more accurately determine the force necessary to stroke the ball through the target area towards the hole.

Another object of this invention is to assist the golfer to develop skill in observing or reading the green and to develop judgment and skill regarding the amount of deflection and force necessary to stroke the ball.

Other objects, features and advantages of the present invention will become apparent to those versed in the game of golf from a consideration of the following description, the appended claims and the accompanying drawing.

BRIEF DESCRIPTION OF THE DRAWINGS

In the accompanying drawings similar reference characters refer to similar elements throughout and in which.

DETAILED DESCRIPTION OF THE PREFERRED EMBODIMENTS

Figure 1:
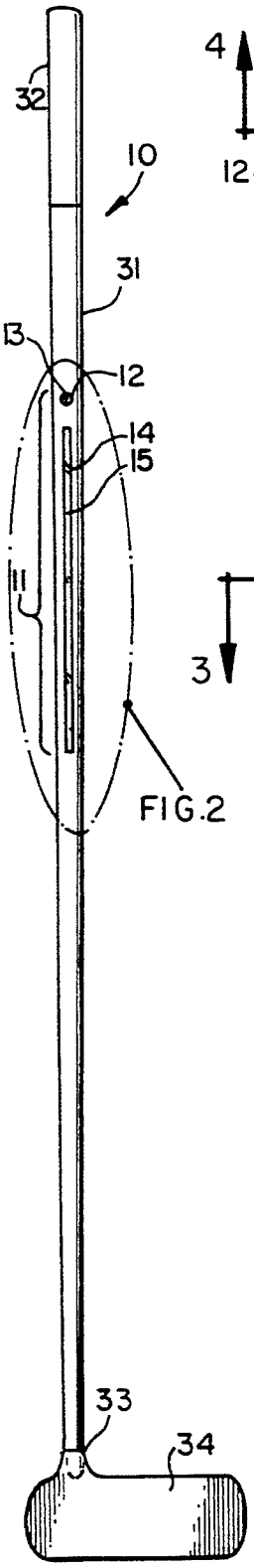
FIG. 1 is side elevation of a golf club having transparent portions comprising in spatial relationship an aperture positioned above a vertically extending slot having transparent portions according to one of the principles of the present invention.
Figure 2:
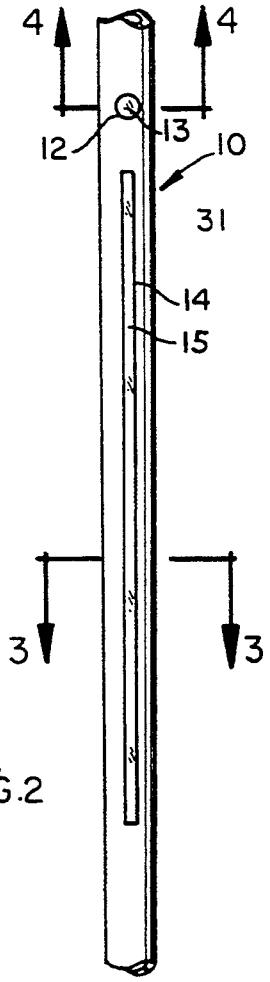
FIG. 2 is an enlarged sectional view of the sighting means of the shaft of FIG. 1.

Referring now to the drawing, there is shown in FIGS. 1 and 2 a golf club 10 having a tapered elongated shaft and a head 34 fixed at the end 33 which is provided with sighting arrangement means 11 comprising in spatial relationship a circular aperture 12 and a vertically extending rectilinear slot 14. Generally a conventional standard steel shaft 31 can be modified to incorporate the sighting arrangement means 11 by machining or stamping through the hollow interior of the shaft 31 about 13 inches to about 24 inches from the club head attachment a vertically extending rectilinear slot 14, 14' in the plane demarcated by the vertical axis of the shaft measuring from about 4 inches to about 7 inches long and about $\frac{1}{8}$ inches wide. The circular aperture 12 about $\frac{1}{4}$ inch to about $\frac{3}{8}$ inch in diameter is drilled about $\frac{3}{4}$ inch to 1 inch above the elongated vertical slot 14, 14'. The aperture 12 and the slot 14, 14' may be left open.

The aperture may take any geometric form but a circular form is preferred for ease in manufacture.

Figure 3:
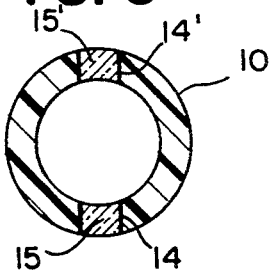
FIG. 3 is a cross-sectional view taken along line 4—4 of FIG. 2.
Figure 4:
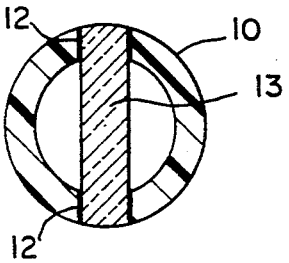
FIG. 4 is a cross-sectional view taken along 3—3 of FIG. 2.

FIGS. 3 and 4 show a preferred embodiment in which transparent inserts 13 and 15, 15' may be incorporated into circular aperture 12 and slots 14, 14' and may be secured by adhesives or other means. FIG. 4 illustrates an embodiment wherein the transparent insert 13 is in one piece and extends through the shaft 31. FIG. 4 shows an embodiment taken along line 4—4 which two transparent inserts 15, 15' and are incorporated into shaft 31 with the remainder of the shaft being essentially hollows. The transparent members 13 and 15, 15' may be provided with indicia means. The indicia means (not shown) may be opaque. In the case of transparent member 15, 15' the indicia means comprises a thin line lying in a plane containing the vertical axis of the shaft means 31. The indicia means (not shown) may also comprise an opaque thin line on the external peripheral surface. Obviously, a plurality of lines may be defined on the device, instead of a single line. Additionally, the circular aperture 13 may be provided with cross hair indicia.

The present elongated shaft 31 can be made of any material desired but typically standard steel or aluminum, titanium, graphite or fiberglass is utilized.

The elongated shaft 31 of this invention can be manufactured in several ways depending on the material chosen. As mentioned hereinbefore a steel shaft can be machined or stamped to provide the necessary openings. In fact with other metal or metal alloys such as aluminum, machining and stamping operations are usually employed. Materials such as graphite and fiberglass do not lend themselves to stamping operations.

Another embodiment relative to the method of making comprising filling the tubular shaft with a liquid epoxy-catalyst mixture, curing this mixture to yield a transparent shaft within the outer tubular shaft. Subsequently, the outer tubular shaft is cut away in the pattern disclosed to provide the sighting arrangement of this invention.

Suitable materials for use as transparent members 13 and 15, 15' are clear thermoset polymers which include polyacrylic, polycarbonate, polyester, phenolic, urea-formaldehyde, acetal, epoxy or allyl carbonate polymers.

Figure 5:
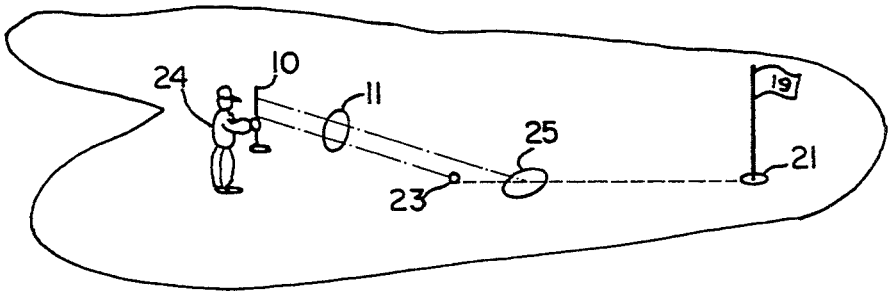
FIG. 5 is a perspective view of a golf green showing the use of the present invention by a golfer.

Referring to the drawing, FIG. 5 illustrates the use of a golf putter 10 having the sighting arrangement 11 of this invention. A golf green is illustrated having a cup or hole 21 having a pole and flag. A golfball 23 is positioned between the hole 21 and a golfer 24 freely holding golf club 10, i.e., like a pendulum in a vertical position is shown. In use with the ball 23 and positioned as shown is the golfer 24 who first sights the ball through the vertical slots 14, 14' on an imaginary line between the ball 23 and cup 21 then observes through the circular aperture 12 an imaginary target area 25 on the green. With such observations the golfer is able to determine the amount of force necessary to stroke the ball through the target area 25 in order to cause the ball to take the appropriate path to the cup. The invention provides an accurate reference in the combination view with an imaginary line between the ball and the cup, thereby enabling the golfer to estimate and judge with relative accuracy the deflection and force necessary to apply to a ball to compensate for the cumulative effect of the slopes or undulations and the lie or break of the grass.

While the golf shaft 10 of the present invention can be used with various club heads, it is preferred to use the shaft 31 with particular benefit in combination with a putter head 34.

In FIG. 1, at one end of the shaft 10, having sighting means 11, is provided with a grip means 32. The grip means 32 may be a conventional golf club grip, i.e., a winding strip of leather or a preformed plastic grip which is applied in the conventional manner. At its other end 33 the shaft 31 is secured to a putter head 34 made of metal, plastic or other material. The putter, thus for described is of conventional design and it is appreciated that in practice a considerable variation in the shape of the head may be suitable.

Although a specific embodiment of the present invention has been illustrated and described herein, it will be understood that the same is merely exemplary of presently preferred embodiments capable of obtaining the objects and advantages hereinbefore mentioned, and that the inventions is not limited thereto; variations will be readily apparent to those versed in the art, and the invention is entitled to the broadest interpretation within the terms of the appended claims.

What is claimed is:

1. In a golf club the improvement comprising a generally cylindrical shaft provided with a sighting arrangement means comprising an aperture through said shaft in a spatial relationship above a vertically extended slot for both sighting through said shaft and projecting an imaginary target area on the ground.

2. The golf club according to claim 1 wherein said aperture and said vertically extending slot contain transparent thermoset plastic inserts.

3. The golf club according to claim 2 wherein said transparent thermoset plastic inserts are selected from polyacrylic, polycarbonate, polyester, phenolic, urea-formaldehyde, acetal, epoxy or allyl carbonate polymers.

4. The golf club according to claim 2 wherein the thermoset plastic is a polyacrylic polymer.

5. The golf club according to claim 2 including indicia means.

6. The golf club according to claim 1 wherein said aperture is circular.

7. The golf club according to claim 1 wherein said shaft is made of a material selected from steel, aluminum, titanium, graphite or fiberglass.

8. The golf club according to claim 7 wherein the material is steel.

9. The golf club according to claim 5 wherein said aperture insert is in the form of cross-hairs and the vertically extended slot insert is a line coincident with the vertical axis of the shaft.

10. A method of making a hollow golf shaft having a sighting arrangement through said shaft comprising the steps of:

machining or stamping a vertically extending rectilinear slot through the hollow interior of the shaft in a plane demarcated by the vertical axis passing through said shaft; and providing an aperture in spatial relationship above said rectilinear slot, whereby sighting through said shaft by means of said aperture and slot occurs.

11. A method of making a hollow golf shaft having a sighting arrangement through said shaft comprising the steps:

filling the hollow interior of said shaft with a transparent epoxy-catalyst mixture;

curing said transparent epoxy-catalyst mixture to form an inner shaft within said shaft;

cutting vertically rectilinear slots in a plane demarcated by the vertical axis passing through the shaft of 180° from each other in said outer shaft;

and cutting two circular apertures 180° from each other in said outer shaft above said slots, whereby sighting through the shaft by means of the apertures and slots occurs.

12. A golf club comprising a cylindrical shaft provided at one end with grip means, having at another end an attached club head, and an intermediate section comprising a sighting arrangement means extending in spatial relationship through said shaft comprising a circular aperture positioned above a vertically extended slot for both sighting through said shaft and projecting an imaginary target area on the ground.

13. The golf club of claim 11 wherein said club is a putter.

* * * * *